United States Patent [19]

Trolle et al.

[11] 4,060,359

[45] Nov. 29, 1977

[54] ISOSTATIC PRESS

[75] Inventors: Sten Trolle; Åke Jonson, both of Ystad, Sweden

[73] Assignee: AB Carbox, Ystad, Sweden

[21] Appl. No.: 766,876

[22] Filed: Feb. 9, 1977

[30] Foreign Application Priority Data

June 10, 1976 Sweden ..... 7606596

[51] Int. Cl.[2] ..... B30B 5/02; B30B 11/00

[52] U.S. Cl. ..... 425/78; 425/185; 425/193; 425/405 H

[58] Field of Search ..... 425/78, 405 H, 185, 425/193

[56] References Cited

U.S. PATENT DOCUMENTS

| | | | |
|---|---|---|---|
| 3,550,198 | 12/1970 | Roberts | 425/405 H X |
| 3,566,450 | 3/1971 | Roberts | 425/405 H X |
| 3,593,373 | 7/1971 | Loomis | 425/405 H X |
| 3,618,164 | 11/1971 | Rietmann | 425/405 H X |
| 3,830,607 | 8/1974 | Baxendale et al. | 425/405 H X |

*Primary Examiner*—J. Howard Flint, Jr.
*Attorney, Agent, or Firm*—Flynn & Frishauf

[57] ABSTRACT

An isostatic press comprises a pressure vessel defined by a tubular jacket and by two end plugs. The jacket is, in the direction of its longitudinal axis, displaceble between two positions. The jacket surrounds a third plug centrally located between the two positions of the jacket so that, when the jacket is in one of its end positions, the central plug closes one end of the jacket, and vice versa. The two jacket positions alternatingly serve as pressing and charging positions so as to permit recharging of the press at one position simultaneously with carrying out a pressing operation at the other position. This arrangement approximately doubles the productivity of the press.

15 Claims, 3 Drawing Figures

ISOSTATIC PRESS

This invention relates to an isostatic press, and more particularly to an isostatic press providing increased productivity.

BACKGROUND OF THE INVENTION

Prior art isostatic presses as a rule comprise a frame surrounding a cylindrical pressure vessel the longitudinal axis of which is vertical. At the top and bottom ends of the vessel there are end plugs. The lower end plug often forms an integral bottom whereas the top plug is removable for the purpose of permitting introduction of the charge and removal of the pressed articles. Accordingly, when the top plug is to be removed, the vessel must be separated from the frame which is achieved by lateral displacement of either the vessel or the frame. Before such displacement can be carried out it is, however, obviously necessary to create a clearance between the top plug and the frame. This clearance can be created in the way that the top plug, which has threads engaging corresponding threads in the jacket of the vessel, is rotated so that it is displaced downwards. It is, however, important to note that this solution is practical only in respect of relatively small vessels.

When the vessel has been displaced relative to the frame and the top plug removed, the finished articles are taken out, whereupon a further charge is introduced. Then the top plug is again mounted, whereupon the vessel is again brought into force-transmitting contact with the frame. Finally, the interior of the vessel is pressurized so that isostatic pressing occurs. After depressurization the cycle above described is repeated. As is understood, that cycle comprises several steps which have to be carried out manually. For that reason this type of cycle is comparatively time-consuming and cannot be automated. This explains why it has not so far been commercially realistic to use isostatic presses for the manufacture of mass produced articles. On the other hand, the isostatic pressing method has several inherent advantages which makes that method interesting also in the just-mentioned context. An example of such a potential field of use is the manufacture of piston rods for small and medium sized internal combustion engines. Experiments have been conducted for the purpose of manufacturing such connecting rods with the use of prior art isostatic presses but it has turned out that, in comparison with conventional presses, the productivity is too low to be tolerable from an economical point of view.

one of the potential inherent advantages of isostatic presses above referred to is that a very accurate shaping of the pressed articles can be guaranteed, since the final dimensions of the pressed articles are only dependent on the accuracy at which the metal powder to be pressed is charged. This charging can be carried out very accurately. Another major advantage stems from the possibility to precisely control and, if necessary, also to change, the composition of the metal alloy used. This advantage is the result of the fact that the corresponding problem is, in the isostatic pressing technique, reduced to correctly proportioning the relative amounts of the components making up the alloy.

The main object of the present invention is to provide an isostatic press having a productivity comparable to that of conventional drop forging presses. It should be appreciated that realization of that object means that the isostatic pressing method becomes equivalent to the conventional methods as far as manufacturing costs are concerned, the net advantage being the higher quality and lesser tolerances of the articles produced.

SUMMARY OF THE INVENTION

The present invention accordingly is directed to an isostatic press of the type comprising a pressure vessel having a substantially tubular jacket the ends of which are, during the pressing operation, closed by a pair of plugs. According to the main characteristic of the invention the jacket is, in the direction of its longitudinal axis, displaceable between two positions alternatingly serving as the charging position and the pressing operation position, respectively. When the jacket is in the pressing operation position its ends are closed by two plugs one of which does, during the movement of the jacket between its two positions, like a piston carry out a relative longitudinal movement inside the jacket.

BRIEF DESCRIPTION OF THE DRAWINGS

One embodiment of the invention will now be described with reference to the drawing.

DETAILED DESCRIPTION

Figure 1:
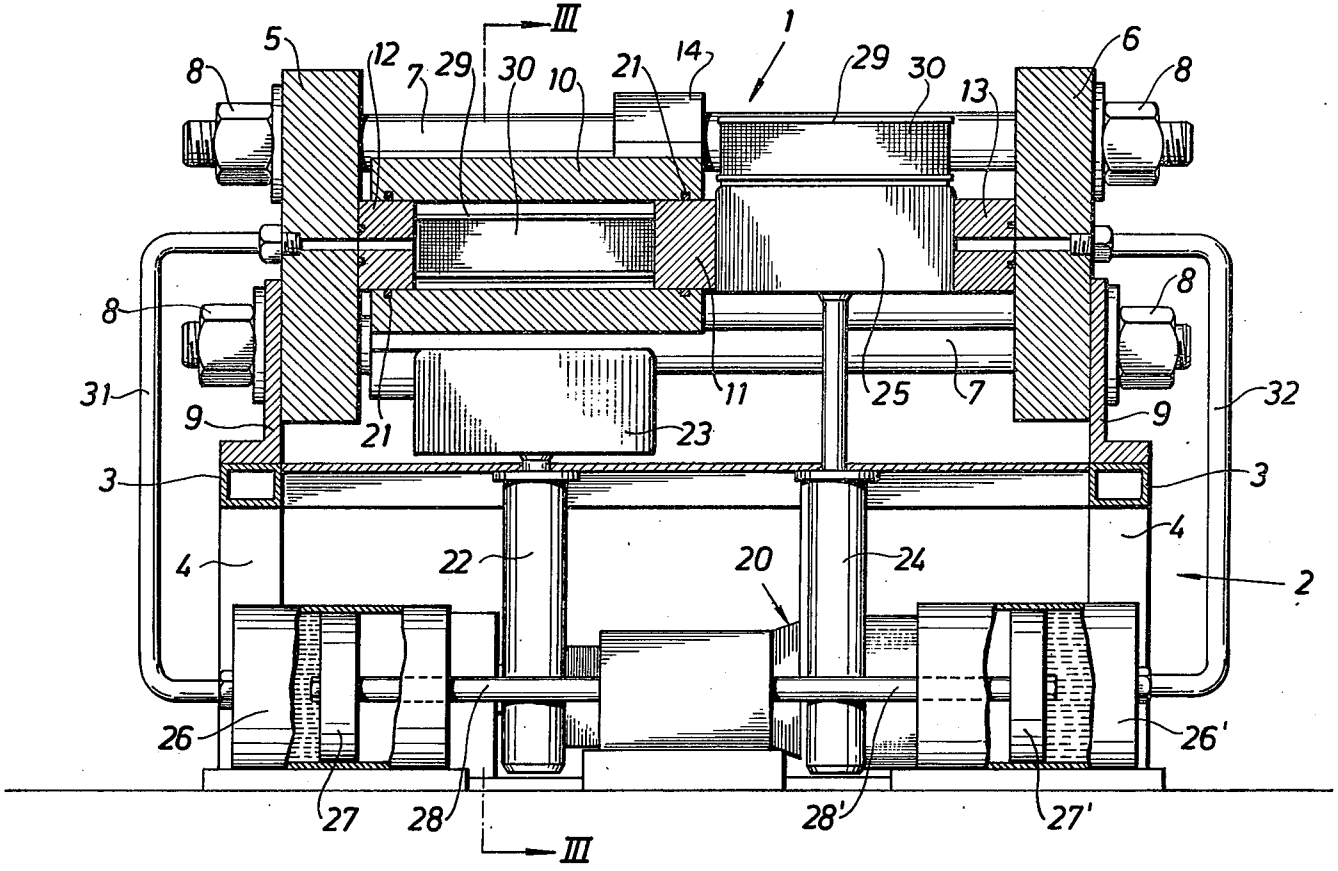
FIG. 1 is a longitudinal section through an isostatic press according to one embodiment of the invention.

Referring to FIG. 1, the isostatic press 1 rests on a support 2 comprising a horizontal frame 3 supported by legs 4. The frame includes two heavy end discs 5 and 6, interconnected by four longitudinal tension rods 7 the ends of which carry nuts 8 externally of discs 5 and 6. The two lower tension rods 7 pass through apertures in a pair of angle brackets 9 by means of which the frame is conneced to the support 2.

Disposed between discs 5 and 6 is the pressure vessel comprising a tubular jacket 10 which, in the direction of its longitudinal axis, is movable between two end positions. When the jacket 10 is in either of those two end positions, and also when it assumes an arbitrary intermediate position, it encloses a centrally located plug 11. When the jacket 10 is in its left-hand end position — shown in FIG. 1 — plug 11 closes the right-hand end aperture of the jacket, the left-hand aperture being closed by a plug 12 carried by disc 5. Correspondingly, when jacket 10 is in its right-hand end position, the centrally located plug 11 will keep the left-hand end aperture of the jacket closed, the other aperture being closed by a plug 13 carried by disc 6.

Figure 2:
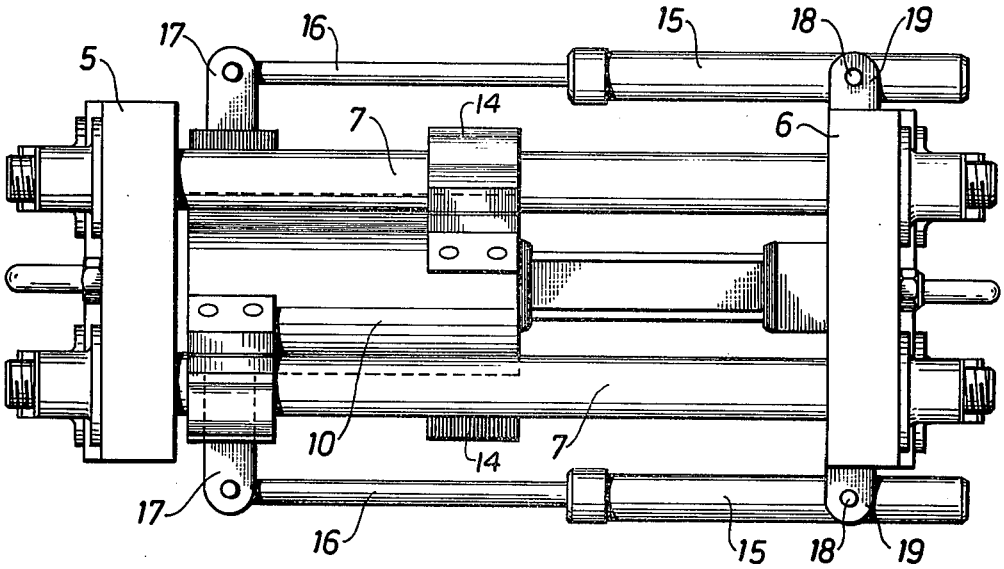
FIG. 2 is a horizontal view of the press shown in FIG. 1.
Figure 3:
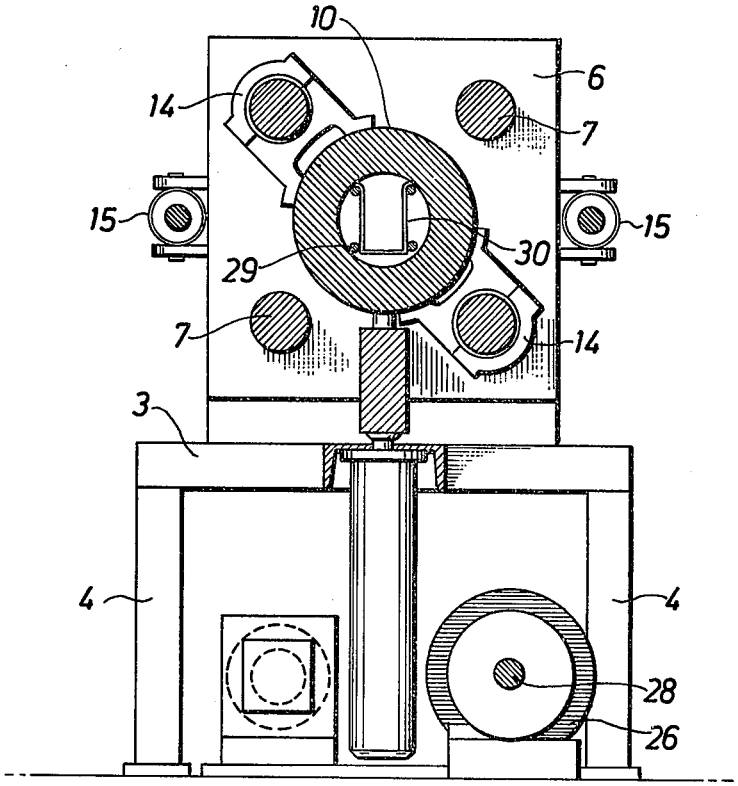
FIG. 3 is a section taken along line III—III in FIG. 1.

The above-mentioned horizontal movement of jacket 10 is controlled by two slides 14 engaging two of rods 7. According to the illustrated embodiment, the two tension rods 7 cooperating with slides 14 are located diagonally opposed as seen in FIG. 3. Those two rods 7 accordingly serve a dual purpose, they are tension rods and they act as guides cooperating with slides 14. As best seen in FIGS. 2 and 3, the movement of slides 14 and, thus, of jacket 10 is effected by a pair of double-acting hydraulic cylinders 15 the piston rods 16 of which have their free ends pivotably connected to arms 17 which in turn are secured to jacket 10. Cylinders 15 also have pivots 18 carried by lugs 19 on disc 6. The purpose of this pivot arrangement is to avoid any seizing or jamming between the movable components should the two hydraulic cylinders not operate completely in unison. In the operation of the press the hydraulic servo cylinders 15 are controlled automatically via pipes and valves not shown on the drawing. The hydraulic working pressure required by the cylinders 15 and by the other hydraulic units of the press is creared by a hydraulic pressure generator 20 (FIG. 1).

In the inner wall of jacket 10 and adjacent each of its two ends there are grooves housing sealing rings 21 (FIG. 1). By virtue of the fact that the sealing rings 21 are carried by jacket 10 rather than by plugs 11–13, two important advantages are realized. One advantage is that only two sealing rings are needed instead of three. The second advantage is that, during the displacement of the jacket, the sealing rings will be subjected to wear only during that small portion of the displacement distance when they are in contact with any one of the plugs. Stated in other words, during the remaining portion of the displacement movement of the jacket sealing rings 21 will not slide relatively any portion of the press.

As seen in FIG. 1, below frame 3 there are two hydraulic cylinders 22 and 24, each of which is located centrally below the one of the two end positions which jacket 10 may assume. The piston rods of the two cylinders 22, 24 at their free ends carry heavy spacer blocks 23 and 25, respectively. As seen in FIG. 1, the dimension of each of the blocks 23, 25 in the direction of the longitudinal axis of the jacket corresponds to the spacing between the two pairs of end surfaces facing each other. In other words, the horizontal dimension of the blocks 23, 25 equals the distance between plugs 12 and 11 and between plugs 11 and 13.

In FIG. 1 block 23 is in its lower passive position below jacket 10, whereas block 25 occupies its operational position in contact with plugs 11 and 13. The significance thereof will be described below.

In accordance with the embodiment here illustrated a pressure liquid container 26 is arranged to introduce pressurized liquid into the pressure vessel defined by jacket 10 and plugs 11, 12 via a conduit 31. Container 26 surrounds piston 27 (FIG. 1) which by means of a rod 28 and control means (not shown) is reciprocable inside the container 26. A corresponding arrangement 26'–28' supplies pressurized liquid via conduit 32 to the vessel defined between plugs 11 and 13 when jacket 10 is instead in its right-hand end position.

As appears from the description above, jacket 10 is movable between two different operational positions. When in one of those two positions, according to FIG. 1 the left-hand one, jacket 10 surrounds four longitudinal spacing rods 29 shown in FIGS. 1 and 3. The four rods 29 are interconnected as seen in FIG. 3. According to FIG. 1 the right-hand set 29 rests on top of block 25. Rods 29 also have dual functions. They have the same length as blocks 23, 25 and thus they serve as spacer means preventing the central plug 11 from being unintentionally displaced during the movement of jacket 10. The second function of rods 29 is that each of the two sets above referred to form a "basket" 30 which during the pressing cycle supports the metal powder inside the pressure vessel and, in addition thereto, facilitates introduction of the powder and removal of the pressed articles.

The operation of the apparatus above described is as follows.

Let it first be assumed that the various components of the machine assume the positions illustrated in FIG. 1. This means that powder to be pressed isostatically is inside the pressure vessel defined by jacket 10 and plugs 11, 12. Block 25 is in contact with plugs 11 and 13 so that, pressurization of the interior of the vessel cannot displace plug 11 in the right-hand direction. Such pressurization is achieved by moving piston 27 inside container 26 to the left. Thereby the pressure liquid will, via pipe 31, enter the interior of the pressure vessel. As appears from the drawing, pipe 31 communicates with a central bore through disc 5 and plug 12. It should be particularly noted that provided container 26 is dimensioned so that one stroke of its piston 27 suffices to create the necessary operational pressure inside the vessel, then it is superfluous to install non-return valves between the container and the pressure vessel. Instead, those two spaces can be in permanent communication via pipe 31.

When the pressing step has been completed, piston 27 is displaced back to its initial position, whereby the vessel is depressurized.

During the next step of the operation cycle block 25 is moved down to its lowermost position. When it has reached that position, basket 30 will assume a centered position between plugs 11 and 13. The next step involves actuation of cylinders 15 so that jacket 10 is moved to the right. As has already been mentioned, basket 30 between plugs 11 and 13 prevents plug 11 from, by frictional forces, to take part in the movement of the jacket. It has also been pointed out above that, during the major portion of that movement, sealing rings 21 are out of contact with the plugs. For the sake of completeness it should be added that, quite naturally, jacket 10 is not displaced until a metal powder charge has been introduced into the right-hand basket 30.

When jacket 10 has reached its right-hand end position, it will accordingly together with plugs 11 and 13 define a pressure vessel. However, before that vessel can be pressurized, spacer block 23 has to be raised to its position between the end surfaces of plugs 11 and 12. This movement having been completed, piston 27' in the right-hand container 26' is moved to the right, whereby the pressure vessel just referred to is pressurized via pipe 32. The operational cycle above described may then be repeated.

The objects of the invention referred to above are realized mainly due to the fact that the press has two operational positions. This makes it possible to control the press automatically or, under all circumstances, semi-automatically. The increased productivity is the result of the possibility of charging one pressing station simultaneously with a pressing operation occurring at the other station. In this way, the operational cycle duration is radically shortened in comparison with prior art isostatic presses. A typical cycle time is 6 seconds corresponding to a productivity of 10 pressing operations being completed per minute.

Finally, it should be emphasized that, in the practical application of the invention, it is possible in several respects to deviate from the embodiment here illustrated by way of example only. The basic inventive idea is that the jacket of the pressure vessel is displaceable between two operational positions and that, during such a movement, it surrounds a centrally located plug which in the one operational position of the jacket is at its one end and, in the other operational position, forms an end plug at the opposite end of the jacket. It is per se fully feasible to arrange more than two axially disposed pressing stations served by one jacket but it has been estimated that such an embodiment is very seldom warranted from an economical point of view. On the other hand, it is suitable to connect in parallel two or more jackets which are accordingly displaced in unison. It should be understood that when the longitudinal axis of the presence vessel is horizontal, as shown on the drawing, the advantages accompanying the invention are optimized. This does, however, not mean that a vertical arrangement of the pressure vessel would fall outside the scope of the invention.

What is claimed is:

1. An isostatic press, comprising frame means (3);

a tubular jacket (10) slidably mounted to said frame means (3), said jacket (10) having end apertures and being longitudinally displaceable at least between two end positions on said frame means;

at least three plugs (11,12,13) mounted to said frame means (3), two of said plugs (12,13) being at respective ends of the travel of said jacket (10) and the remaining plug (11) being intermediate said ends;

the end apertures of said jacket (10), when said jacket (10) is in each of its end positions, being engaged and closed by one of said two end plugs (12,13) and by an intermediate plug (11) so as to form a pressurizing vessel with said engaged plugs, whereby the side of said frame means which is free of said jacket (10) may be charged in preparation for a pressurizing operation thereat.

2. The isostatic press of claim 1, comprising means (31,32) coupled to said end plugs (12,13) for pressurizing the vessel.

3. The isostatic press of claim 2, comprising a double-acting hydraulic unit (26,27) alternatingly pressurizing the vessel in each of the at least two pressing positions of said jacket (10); and wherein said end plugs (12,13) have through bores therein; said unit comprising two cylinder chambers communicating with said through bore in one of said end plugs (12,13).

4. The isostatic press of claim 1, wherein said jacket (10) comprises sealing means (21) disposed in the inner wall thereof and selectively engaging said plugs (11,12,13).

5. The isostatic press of claim 4, wherein said sealing means (21) engages said plugs only in the vicinity of the pressurizing positions of said jacket (10).

6. The isostatic press of claim 1, comprising means for displacing said jacket (10) relative to said frame means (3), said displacing means including a plurality of double-acting hydraulic control cylinders (15,16); at least one slide (14) coupled to said cylinders (15,16) and to said jacket (10), said at least one slide being slidable relative to said frame means (3).

7. The isostatic press of claim 6, wherein said frame means (3) comprises at least two end plates (5,6) and a plurality of tension rods (7) coupling said plates together, said at least one slide (14) being slidable relative to at least one of said tension rods, said tension rods (7) absorbing the axially oriented reactional forces to which lugs (11,12,13) are subjected during a pressurizing operation.

8. The isostatic press of claim 1, comprising at least two spacer blocks (23,25), which are alternatingly movable between an active position between an intermediate plug (11) and one of said two end plugs (12,13) to prevent displacement of said intermediate plug (11) during a pressurization operation, and a passive position away from said plugs and in which it permits said longitudinal displacement of said jacket (10) relative to said frame means (3).

9. The isostatic press of claim 8, comprising three plugs, said intermediate plug (11) being located substantially centrally between said end plugs (12,13).

10. The isostatic press of claim 1, comprising spacing means (29) selectively engageable with the intermediate plug (11) for retaining the intermediate plug (11) in its position during longitudinal displacement of said jacket (10).

11. The isostatic press of claim 9, wherein said spacing means (29) comprises a plurality of rods.

12. The isostatic press of claim 10, comprising three plugs, said intermediate plug (11) being located substantially centrally between said end plugs (12,13).

13. The isostatic press of claim 10, comprising at least two spacer blocks (23,25), which are alternatingly movable between an active position between an intermediate plug (11) and one of said two end plugs (12,13) to prevent displacement of said intermediate plug (11) during a pressurization operation, and a passive position away from said plugs and in which it permits said longitudinal displacement of said jacket (10) relative to said frame means (3).

14. The isostatic press of claim 1, comprising three plugs, said intermediate plug (11) being located substantially centrally between said end plugs (12,13).

15. The isostatic press of claim 1, wherein said frame means (3) comprises at least two end plates (5,6) and a plurality of tension rods (7) coupling said plates together and absorbing the axially oriented reactional forces to which said plugs (11,12,13) are subjected during a pressurizing operation.

* * * * *